US005352891A

United States Patent [19]

Monnig et al.

[11] Patent Number: 5,352,891

[45] Date of Patent: Oct. 4, 1994

[54] METHOD AND APPARATUS FOR ESTIMATING MOLECULAR MASS FROM ELECTROSPRAY SPECTRA

[75] Inventors: Curtis A. Monnig; Jeffrey J. Hagen, both of Riverside, Calif.

[73] Assignee: The Regents of the University of California, Oakland, Calif.

[21] Appl. No.: 92,845

[22] Filed: Jul. 16, 1993

[51] Int. Cl.[5] ..... H01J 49/00

[52] U.S. Cl. ..... 250/282; 364/498

[58] Field of Search ..... 250/282; 364/498

[56] References Cited

U.S. PATENT DOCUMENTS 5,072,115 12/1991 Zhou ..... 250/282

5,130,538 7/1992 Fenn et al. ..... 250/282

OTHER PUBLICATIONS

"Interpreting Mass Spectra of Multiply Charged Ions," Mann et al., Anal. Chem. 1989, 61, 1702–1708.

"Electrospray Ionization Mass Spectrometry: Deconvolution . . . ," Reinhold et al., J Am Soc Mass Spectrom 1992, 3, 207–215.

"Tandem Mass Spectrometry of Very Large Molecules: Serum Albumin . . . ," Loo et al., Anal. Chem. 1991, 63, 2488–2499.

"New Developments in Biochemical Mass Spectrometry: Electrospray Ionization," *Perspective: Analytical Bitechnology,* Anal Chem. 1990, 62, 882–899.

"Electrospray Mass Sepctrometry of Poly(ethylene glycols) with Molecular . . . ," Nohmi et al., J. Am. Chem. Soc. 1992, 114, 3241–3246.

*Primary Examiner*—Jack I. Berman

*Attorney, Agent, or Firm*—Daniel L. Dawes

[57] ABSTRACT

The production of mass spectra of chemical compounds of high molecular weights having a multiplicity of peaks is improved by generating an enhanced mass spectrum from the observed mass-to-charge spectrum. The intensity at each point within the enhanced spectrum is based upon a plurality of successive discrete peaks within the mass-to-charge spectrum. The intensities of the sequence of mass-to-charge peaks are combined to form a normalized product which is the new enhanced intensity at an assumed molecular weight. The intensities of the mass-to-charge spectrum at each integral fraction of the assumed molecular weight are included in the product. Only those intensities above a certain predetermined threshold, however, are included to avoid transfer of noise into the enhanced spectrum. Signal-to-noise ratio can in some applications be improved by including in the product all portions within the discrete peaks in the mass-to-charge spectrum which are contained within a window around each of the discrete peaks.

20 Claims, 8 Drawing Sheets

METHOD AND APPARATUS FOR ESTIMATING MOLECULAR MASS FROM ELECTROSPRAY SPECTRA

This invention was made with government support under Grant No. CHE-91-8530 awarded by the National Science Foundation, The Government has certain rights in this invention.

BACKGROUND OF THE INVENTION

1. Field of the Invention

The invention relates to methodologies for analyzing the mass spectrum of macromolecules from ionization sources and in particular to a methodology directed to enhancing the mass spectrum by emphasizing molecular peaks distributed across a plurality of charged states.

2. Description of the Prior Art

Mass spectroscopy is a tool used for characterizing macromolecules. Recently, technologies have been developed for matrix assisted laser desorption and electrospray ionization (ESI) methods for introducing samples into the mass spectrum analyzers. These new techniques allow very high molecular weight species to be introduced into a gas phase and ionized without significant degradation of the macromolecule. Electrospray ionization also has the advantage of having a very high ionization efficiency, which allows useful spectra required for even very small quantities of material. See R. D. Smith et al. Anal. Chem. 1990, 62, 882–99. Additionally, an ESI source is able to deposit multiple charges on a single molecule in a very reproducible manner. See Smith supra, M. Mann et al. Anal. Chem. 1989. 61, 1702–8 and J. A. Loo et al., Anal. Chem. 1991, 63, 2488–99.

The ability to put multiple charges on a molecule allows a conventional mugs analyzer with a limited range of mass-to-charge ratios to record a spectrum for very high molecular weight ions. In the extreme, spectra of molecules with molecular weights as large as $10^6$ Daltons have been recorded. See T. Nohmi et al., J. Am. Chem. Soc. 1992, 114, 3241. In addition, when a molecule carries multiple charges, the distribution of charges on the molecule can often be observed. The multiplicity of charge states gives rise to an envelope of peaks in the mass-to-charge spectrum produced by the analyzer. Although the envelope of the spectrum may appear to be complicated, in practice the peaks provide a means by which the mass of the ion can be determined.

However, the use ESI in mass spectrometers has been impeded by a lack of robustness in the methods for determining the mass of the molecule. Many peaks are exhibited in the output of the mass spectrometer such as is typically shown in Fenn et al, "*Method of Producing Multiply Charged Ions and for Determining Molecular Weights of Molecules by the Use of Multiply Charged Ions of Molecules,*" U.S. Pat. No. 5,130,538 (1992), which is incorporated herein by reference.

One methodology, which has addressed the problem of analyzing the peaks to produce a calculated or enhanced output spectrum with greater robustness, is described by Mann, et al., supra. Mann utilizes a methodology based upon the mass-to-charge ratio of peaks in the electrospray spectrum designated as $M_n$. The n designates the number of charges on the ion and $M_p$ is the mass of the parent ion. The mass, $m_c$, is the mass of the counter ion which carries the charge such as a proton, sodium or potassium ion adducted to the molecule from a water solution. Equation 1 below illustrates relationship between these quantities.

$$M_n = M_p/n + m_c \quad (1)$$

In the first methodology described by Mann, there is a requirement that the mass-to-charge ratio, $M_n$, for two peaks in the electrospray spectrum, the charge difference between these two peaks, and the mass of counter ion must be known in order for the methodology to be performed. Given this information, two expressions based upon Equation 1 above can be established and solved to determine the mass of the parent ion $M_p$ which is the object of the methodology.

The difficultly with this prior art methodology is the peak selection process. The information which is required to be known for the methodology, to be used is often difficult to extract from the spectrum produced by the mass analyzer, if there is a poor signal-to-noise ratio or, if the spectrum contains signals from multiple parent ions, i.e. the sample has more than one type of substance in it.

Mann has also proposed a second methodology for use in electrospray spectra by assuming an additive correlation between the peaks in the spectrum. According to the second methodology, the sum of the intensities that each of the peaks in the mass spectrum at integral fractions of a chosen mass is calculated to produce an enhanced intensity. This calculation is repeated over a selected mass range to generate an enhanced mass spectrum.

Although the algorithm is easily implemented, the method generates spurious peaks in the calculated or enhanced spectrum when the selected mass used for the calculation does not correspond to a molecular ion but has a partial correlation with the empirically measured peak envelope. This causes false peaks to be generated which often approach the intensity of the true molecular ion peaks. The result is that the enhanced spectrum is not necessarily easier to interpret than the measured spectrum itself.

More recently, Reinhold and Reinhold describe a methodology which uses maximum entropy to estimate an enhanced mass spectrum from an electrospray mass-to-charge spectrum. See B. B. Reinhold et al., J. Am. Soc. Mass Spectrom. 1992, 3, 207–15. According to the Reinhold methodology, a molecular weight is assumed and the electrospray spectrum is predicted for the assumed mass of the molecule. The difference between the estimated and actual spectrums are calculated and then the difference is plotted as a function of mass over a range selected by the user. The maximum entropy calculation provides added discrimination against artifact peaks generated by the Mann deconvolution methodology, but the calculations in the Reinhold system are slow and a priori knowledge of the peak shapes and relative intensities in the mass-to-charge spectrum are required if there is to be optimal processing of the data.

What is needed then is a methodology for analyzing the mass spectrum of a multiply charged macromolecule which makes better use of the information contained within the electrospray spectrum.

Specifically, what is needed is a methodology which can make use of the fact that electrospray ionization usually distributes an ion signal between two or more charged states on the molecule. Thus, peaks which might arise from the low molecular weight species and the partial correlation between these peaks and the envelope are suppressed relative to the true molecular peaks.

What is needed is a practical approach in which the enhanced mass spectrum of the molecule is easier to interpret than the enhanced spectrums generated by the prior art Mann or Reinhold deconvolution methodologies.

BRIEF SUMMARY OF THE INVENTION

The invention is a method for identifying the molecular weight of distinct polyatomic parent molecular species in a mass spectrometer. The method comprises the steps of generating populations of multiply charged ions on the distinct polyatomic parent molecular species. The number of charges on the ions defines each of the ion's charge state number. The population of ions comprises a plurality of subpopulations. Each of the subpopulations corresponds to an intensity peak in a mass-to-charge spectrum of the molecular species. The population includes one of the subpopulations for at least one possible integral value of a charged state number. The subpopulations in the mass spectrometer are analyzed to produce the mass-to-charge spectrum. A mass-to-charge range to be used witch the mass-to-charge spectrum is determined. A range of assumed masses to be used within an enhanced mass spectrum is determined. For each assumed mass in the enhanced mass spectrum, an intensity equal in magnitude to the product of all of the intensity peaks of the subpopulations of the assumed mass is generated. As a result, a determination of the molecular weight of the polyatomic parent molecule species is more readily discernible.

The step of generating the enhanced intensity comprises the step of generating an enhanced intensity, I[M], equal in magnitude to a product modeled on the equation:

$$I(M)=[I[M/x+m_c]*I[M/(x+1)+m_c]*I[M/(x+2)+m_c]*\ldots*I[M/y+m_c]]/rms^n$$

where M is the molecular mass assumed in the enhanced spectrum, I[M/n] is the intensity of the subpopulations at a mass-to-charge value of n, where x and y are the minimum/maximum number of charges of the charged state number per molecule, where $m_c$ is the mass of a counter ion, where rms is root mean square of the selected range of the mass-to-charge spectrum, and where n is the number of intensity peaks within the product.

In one embodiment the step of generating the enhanced spectrum only uses intensity peaks of the subpopulation within the mass-to-charge spectrum greater than a predetermined threshold. In the illustrated embodiment the predetermined threshold is set at about 0.01% of the maximum intensity found within the mass-to-charge spectrum.

In other embodiments the predetermined threshold has a characteristic maximum value for each spectrum at which a quality factor, QF, is maximized. The predetermined threshold is set at the maximum value to maximize the quality factor. The quality factor is defined as the ratio of the intensity peaks of the subpopulations at a true molecular mass divided by intensity peaks at mass values other than the true molecular mass and integer multiples.

In another embodiment the intensity peaks within the mass-to-charge spectrum have a finite width. The enhanced spectrum is generated from the intensity peaks of the subpopulations using the finite width of each the intensity peaks. The enhanced spectrum is modeled by the equation:

$$I(M)=X_x*X_{x+1}*X_{x+2}*\ldots*X_y$$

where $X_n$ $$X_n=[I[m_n-w/2]*I[m_n-w/2+d]*I[m_n-w/2+2d]*\ldots*I[m_n+w/2]]/rms^{n/d}$$

and $$m_n=M/n+m_c$$

where $X_n$ is a measure of the intensity of the subpopulations centered at a mass-to-charge value of $m_n$, where w is a calculation window and d is the mass difference at successive points in the mass-to-charge spectrum from which the enhanced spectrum is generated.

In the preferred embodiment the enhanced spectrum is generated from a data set of data points corresponding to equivalent masses of the polyatomic parent molecular species. The method comprises the steps of determining a root mean square of the data set and normalizing the data set by dividing each data point by the root mean square of the data set. A width, w, of a window is determined. A product spectrum is generated where each point of the product spectrum is a product of all the data points within the data set within one half of the window width, w/2, in the normalized spectrum. The enhanced intensity I[M] is generated and is equal in magnitude to a product modeled on the equation:

$$I(M)=I[M/x+m_c]*I[M/(x+1)+m_c]*I[M/(x+2)+m_c]*\ldots*I[M/y+m_c]$$

where M is the molecular mass assumed in the enhanced spectrum, I[M/n] is the intensity of the product spectrum at a mass-to-charge value of n, where x and y are the minimum/maximum number of charges of the charged state number per molecule, where $m_c$ is the mass of a counter ion, and where n is the number of intensity peaks within the product.

The invention is also characterized as an improved combination of a mass spectrometer and computer comprising a device for generating a mass spectrum comprised of a sequence of discrete peaks due to multiply charged ions of a distinct polyatomic parent molecular species. A memory circuit stores the mass spectrum within the computer or its memory. The computer includes a circuit for generating an enhanced mass spectrum by combining the sequence of discrete peaks due to multiply charged ions of the distinct polyatomic parent molecular species to form an intensity for each assumed mass within the enhanced spectrum. The discrete peaks are combined in a product. As a result, analysis of the peaks of the enhanced spectrum to determine the molecular weight of the distinct polyatomic parent molecular species is facilitated.

The circuit for generating the enhanced spectrum combines the sequence of discrete peaks in a normalized product. The product is normalized by the root circuit square value of the mass spectrum stored in the computer in a predetermined range from which the enhanced spectrum is generated.

The circuit for combining the sequence of discrete peaks in a product combines the products as modeled by the equation:

$$I(M)=[I[M/x+m_c]*I[M/(x+1)+m_c]*I[M/(x+2)+m_c]*\ldots*I[M/y+m_c]]/rms^n.$$

In one embodiment the circuit for generating the enhanced spectrum combines only those discrete peaks in the product which exceed a predetermined threshold.

In another embodiment the circuit for generating the enhanced spectrum includes within the product a subsequence of intensities for each of the discrete peaks within a width for each peak.

Specifically, in one embodiment the circuit for generating the enhanced spectrum from the sequence of discrete peaks in a product generates the enhanced intensity as modeled by the equation:

$$I(M)=X_x*X_{x+1}*X_{x+2}*\ldots*X_y$$

where $X_n$ $$X_n=[I[m_n-w/2]*I[m_n-w/2+d]*I[m_n-w/2+2d]*\ldots*I[m_n+w/2]]/rms^{n/d}$$

and $$m_n=M/n+m_c.$$

The invention and its various embodiments may now be better visualized by turning to the following drawings wherein like elements are reference by like numerals.

BRIEF DESCRIPTION OF THE DRAWINGS

FIG. 3*a* is the observed mass-to-charge spectrum read from a conventional ESI mass spectrometer. FIG. 3*b* is enhanced spectra of FIG. 3*a* utilizing the prior art methodology of Mann. FIG. 3*c* is an enhanced spectrum of the data of FIG. 3*a* using the prior art methodology of Reinhold. FIG. 3*d* is enhanced spectrum of the data of FIG. 3*a* using the methodology of the present invention.

FIG. 4*a* is the mass-to-charge spectrum for the cytochrome c analyte as produced by a conventional ESI mass spectrometer. FIG. 4*b* is the output of the methodology of the invention using a threshold level expressed as percent of relative intensity of 14% RI. FIG. 4*c* is the quality factor, QF, of enhanced spectra calculated from the mass-to-charge spectrum of FIG. 4*a* shown as a function of threshold level expressed as percent of relative intensity.

FIG. 5*a* is the ESI mass spectrum of the multicomponent mixture as produced by a conventional ESI mass spectrometer. FIG. 5*b* is the enhanced calculated spectrum of FIG. 5*a* processed according to the invention.

FIG. 6*a* is the output of the conventional ESI mass spectrometer. FIG. 6*b* is the mass spectrum calculated from the data in FIG. 6*a* according to the invention.

The invention and its various embodiments may now be better understood by turning to the following detailed description.

DETAILED DESCRIPTION OF THE PREFERRED EMBODIMENTS

The production of mass spectra of chemical compounds of high molecular weights having a multiplicity of peaks is improved by generating an enhanced mass spectrum from the observed mass-to-charge spectrum. The intensity at each point within the enhanced spectrum is based upon a plurality of successive discrete peaks within the mass-to-charge spectrum. The intensities of the sequence of mass-to-charge peaks are combined to form a normalized product which is the new enhanced intensity at an assumed molecular weight. The intensities of the mass-to-charge spectrum at each integral fraction of the assumed molecular weight are included in the product. Only those intensities above a certain predetermined threshold, however, are included to avoid transfer of noise into the enhanced spectrum. Signal-to-noise ratio can in some applications be improved by including in the product all portions within the discrete peaks in the mass-to-charge spectrum which are contained within a window around each of the discrete peaks.

Before describing the methodology of the invention in detail, a basis for its enhanced operability can be understood by observing that if information or a signal is contained in a number of peaks, that information or signal can be emphasized over other uncorrelated information by multiplying the intensity of the correlated peaks together. In other words, if the output peaks for an analyte fall into three peaks having a relative intensity of 1, 1, and 98 (summing to 100%), the product of the intensity of those three peaks is the number 98. However, if the intensity of these three peaks were more evenly distributed, say with relative intensities of 33, 34, and 33, still summing to 100%, the product of these three peaks is dramatically higher, that is 37,026. Thus, if 100% of the signal is split between multiple peaks, the more even the distribution of the signal between the correlated peaks, the higher will be the product when those peaks are multiplied together over peaks not so correlated.

Figure 1:
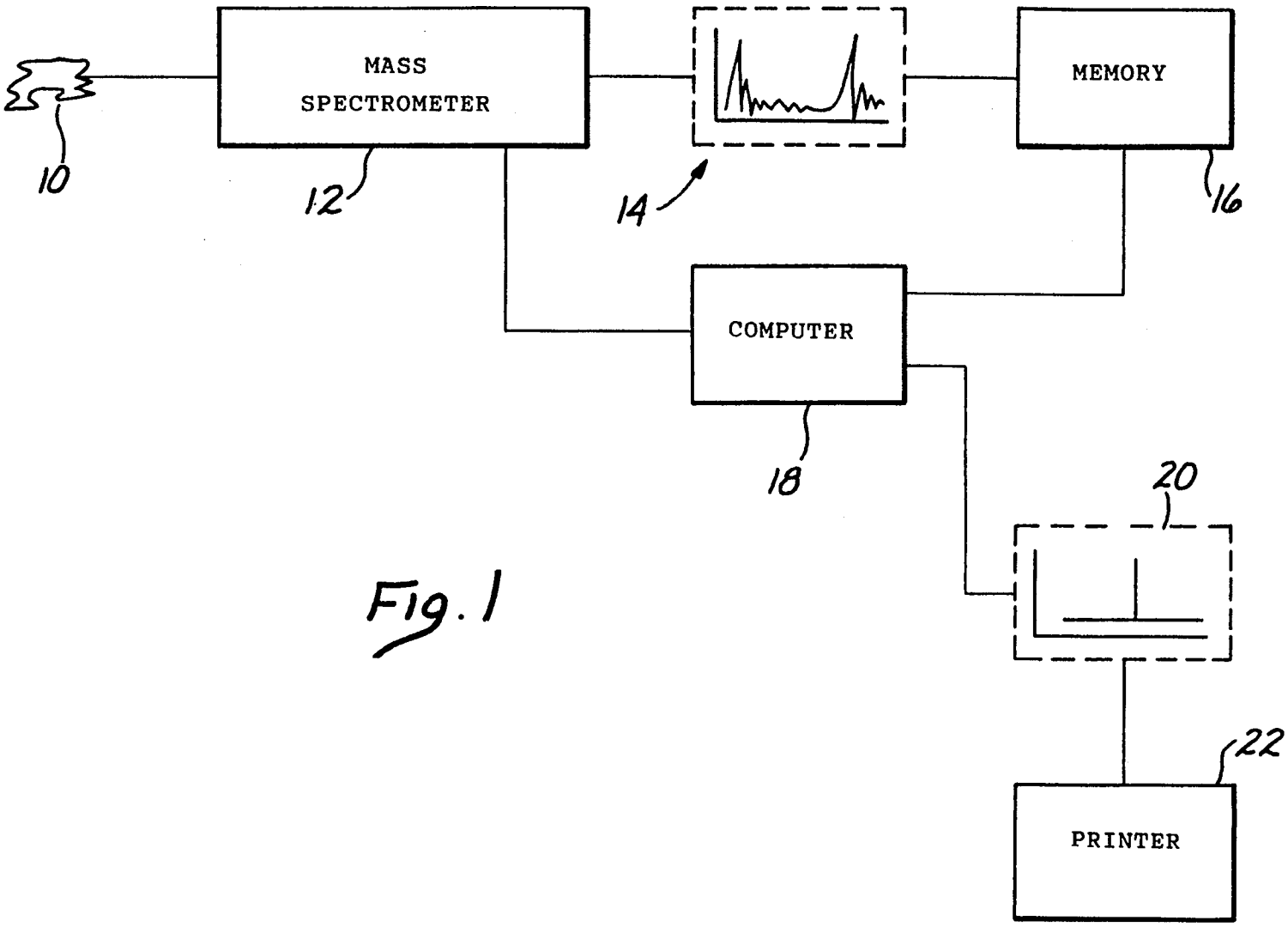
FIG. 1 is a simplified block diagram of the apparatus in which the invention is practiced.

FIG. 1 is a block diagram illustrating a combination of a mass spectrometer 12 and computer 18 in which the present invention is realized. An analyte 10 is injected through an electrospray interface or other means into a conventional mass spectrometer 12. Mass spectrometer 12 produces a mass-to-charge spectrum, symbolically denoted by dotted box 14, which is stored within memory 16. Computer 18, which controls mass spectrometer 12 and memory 16 by conventional software methods produces an enhanced spectrum, symbolically denoted by reference numeral 20 within dotted outline 20, which is communicated to an output device such as printer 22.

Figure 2:
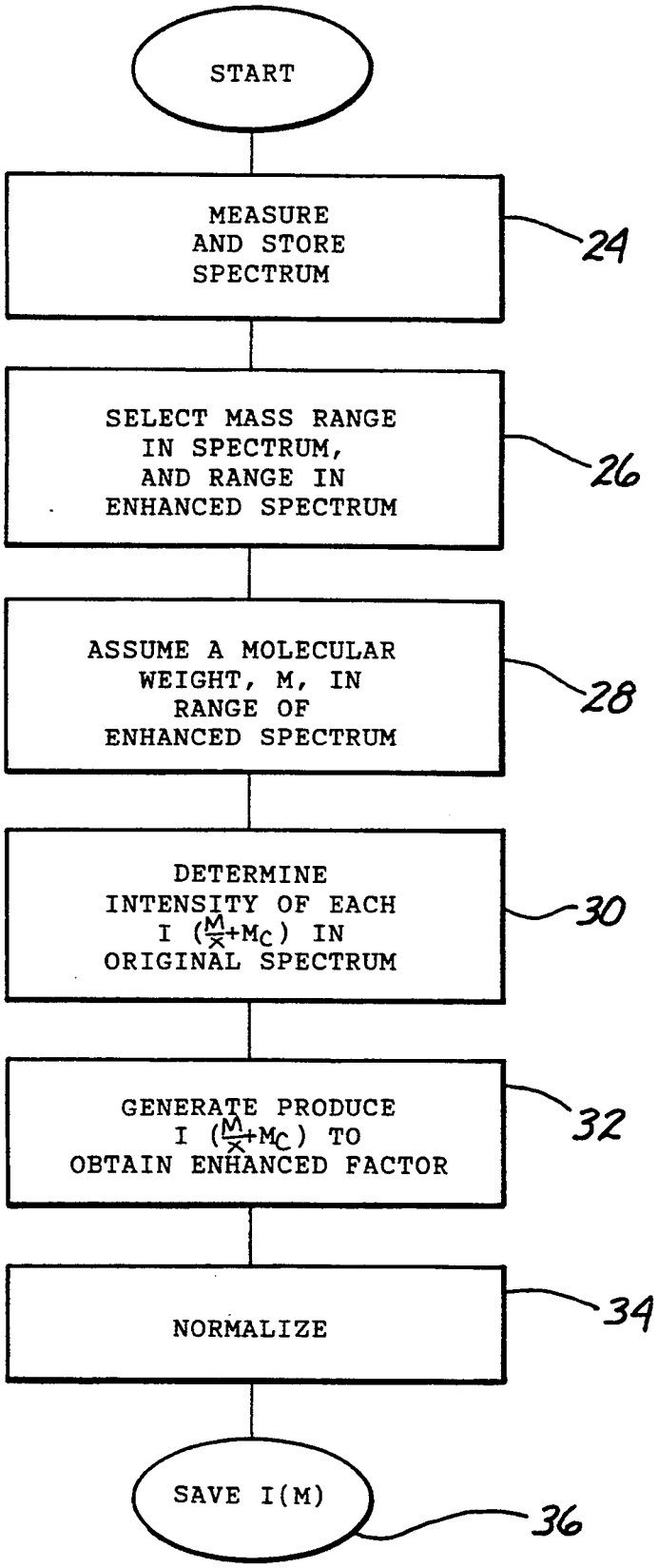
FIG. 2 is a simplified flow chart of the methodology of the invention.

According to the methodology in the invention, the mass-to-charge spectrum from a conventional ESI mass spectrometer such as illustrated in FIGS. 3*a*, 4*a*, 5*a* and 6*a* is read by conventional measurement techniques at step 24 as shown in the flow diagram of FIG. 2. The user then selects at step 26 a range of molecular masses to be searched in the originally measured spectrum and a range of masses to be calculated in the enhanced spectrum. A peak in the enhanced spectrum is assumed at step 28 at a molecular weight in the output range. The peak intensities of all integral fractions of the assumed mass are determined at step 30 taking into account the mass of the counter ion, and then multiplied to obtain an enhanced intensity at step 32. As the assumed mass of the ion increases, the number of peaks which must be multiplied together increase.

To provide for a more constant baseline and peak amplitude across the enhanced spectrum, the product of the signal intensities are divided at step 34 by the root mean square of the original mass-to-charge spectrum for the selected range raised to the power n, which is the number of points which are multiplied together. The result is the normalized enhanced intensity at the assumed molecular weight, I (M). The methodology is modeled by the following Equation 2:

$$I(M)=[I[M/x+m_c]*I[M/(x+1)+m_c]*I[M/(x+2)+m_c]*\ldots*I[M/y+m_c]]/rms^n$$

Where I(M) is the calculated intensity in the deconvoluted spectrum for the mass M. I[N] is the intensity in the mass-to-charge spectrum of a mass N, where x and y are respectively the minimum/maximum number of charges on the molecule. The factor, $m_c$ is the mass of the counter ion. In practice the value of x and y are determined by the range of mass-to-charge values which are searched in the original spectrum and the assumed mass of the parent molecule. The calculation is made for the intensities at each point and the output range which the user has chosen. The outputs calculated according to the methodology is then saved to a data file at step 36.

The influence of noise in the mass-to-charge spectra of FIGS. 3a–6a is minimized in the invention. In the prior art, Mann sought to achieve this noise minimization by restricting the mass-to-charge range searched in the original spectrum. The methodology of the invention is even more sensitive to noise in the original spectrum, since if any of the input intensities were read as a zero or near zero according to noise, then the entire product of Equation 2 would zero out or nearly zero out. To minimize the transfer of noise from the measured spectrum to the enhanced spectrum and to eliminate the possibility of multiplication by zero, the multiplicative methodology of the invention establishes a threshold intensity below which the mass-to-charge data point is ignored. For example, in the illustrated embodiment 0.01% relative intensity is chosen as the minimum threshold with 100% being the highest intensity value in the searched range. It is to be understood that many other threshold levels can be chosen according to the teachings of the invention without departing from its spirit or scope. Any signal intensity is in the original mass-to-charge spectrum which fall below this predetermined threshold then is judged to contain little useful information and to primarily contribute only to the transfer of noise into the reconstructed or enhanced spectrum and is therefore not used in the calculation.

Another way to increase the quality of the enhanced spectrum is to fully utilize the available signal from the analyte. Use of a single data point at the top of the peak ignores any contribution from the finite width of the analyte peaks. A calculation window which includes a range of mass is around each peak centered on the position of the peak in the mass-to-charge spectrum provides a greater portion of the analyte signal in the output than if only a single point on the peak were used.

In addition, detector noise spikes tend to have a much narrower profile than analyte peaks. By calculating the peaks through a window, an analyte signal is enhanced over the noise spikes. In the present invention, the calculation window uses a product of intensities over small range of mass values. Equation 3 summarizes the overall calculation to calculate a intensity in the output or enhanced spectrum.

$$I(M)=X_x*X_{x+1}*X_{x+2}*\ldots*X_y \quad (3)$$

One of the products of Equation 3 is given below in Equation 4. The width of calculation window is w and d is the mass difference at successive points in the mass-to-charge spectrum.

$$X_n=[I[m_n-w/2]*I[m_n-w/2+d]*I[m_nw/2+2d]*\ldots*I[m_n+w/2]]/rms^{n/d} \quad (4)$$

where $m_{n=M/n+mc}$

In the preferred embodiment for simplicity and increase in speed, instead of employing a methodology which is dictated by the above equation, the following process is followed:

a. The data set is normalized by dividing each data point by the root mean square of the entire data set;
b. the width, w, of the window is set;
c. a product or window spectrum is calculated where each point of a product or window spectrum is the product of all the points within one half of the window width, w/2, in the normalized spectrum for the equivalent mass; and
d. deconvolution proceeds as if there were no calculation window except the product spectrum is used in place of the original spectrum and the root mean square is eliminated from the calculation since it has been introduced earlier.

The height of a peak generated by the multiplicative deconvolution methodology of the invention cannot be used as a quantitative determination of the mount of the molecular species measure. However, once the molecular weight of the molecule is determined, the sum of the amplitudes of the peaks in the measured mass-to-charge spectrum are easily identified and provide a quantitative measures of the molecular species which is in the analyte according to conventional methods.

The general methodology now having been described consider specific samples which were analyzed and the results of which are shown in FIGS. 3a–6b. Horse heart myoglobin, horse heart cytochrome c (type III), and hen egg lysozyme standards as produced by Sigma Corporation of St. Louis, Mo. were used without further purification as the demonstrative test samples. Solutions of myoglobin, cytochrome c and lysozyme were prepared by dissolving the lyophilized protein in a 50/50 solution of methanol and 3% acetic acid in deionized water.

The analyte was introduced into a quadrapole mass spectrometer equipped with an electrospray interface and extended mass range options (Model 201 mass filter with options ES and E2000, manufactured by Vestec Corporation of Houston, Tex.). The electrospray spectra obtained from the analytes are displayed in FIGS. 3a–6a. The quadrapole mass analyzer was controlled and data recorded to a dedicated processor controlled by a personal computer having a 80486 CPU using conventional commercial software sold under the name of Vector/Two by Teknivent Corp. of Maryland Heights, Mo.

Each of the above samples were delivered into the electrospray interface by means of syringe pump, Model 341B, built by Sage Instruments of Boston, Mass., with flow rates between 0.96 and 1.83 microliters per minute. The electrospray needle was held between 2 to 3 kilovolts for all samples. The electrospray voltage, distance between the needle and the first skimmer cone, and sample flow rate was adjusted to achieve a stable spray current of approximately 0.2 microamps. The spray chamber was held 70 degrees C., the ion lens was held at 150 degrees C., and block held at 250 degrees C. The repeller voltage was maintained at 20 volts and the pressure in the analyzer at $5\times10^{-6}$ Torr. Under normal operating conditions, the peaks in the mass-to-charge spectrum (full width at half maximum intensity) were approximately 4.0 atomic mass units.

Data was acquired by introducing a solution of analyte into electrospray interface and scanning the resultant ion population in the range of 600 to 2,000 mass-to-charge units at 0.2 mass-to-charge unit intervals. The total quality of the mass spectrum for the protein introduced into mass spectrum analyzer during the signal acquisition period is described in the detailed examples below.

Objective C programs were developed to process the mass-to-charge spectrum according to the methodologies of both the prior art and the present invention. ASCII files of the raw mass-to-charge spectra were transferred from the mass spectrometers 80486 computer to a NeXTCube workstation (25 megahertz, 68040 microprocessor, 16 megabyte RAM, manufactured by NeXT Computer Inc. of Redwood City, Calif.) for analysis. The time required to calculate and display mass spectrum was approximately 40 seconds to generate an enhanced spectrum such as shown in FIG. 3*d* with data points at 1 Dalton increments.

In order to compare spectra quantitatively, a quantity called quality factor, QF, is defined. QF is defined as the intensities of the signal at the true molecular mass divided by the maximum signal intensity at the mass values other than the true molecular mass. QF is therefore analogous to a signal-to-noise measurement and provides a measure of the ease with which the molecular peak can be identified in the presence of background signals or spurious peaks. Therefore, the greater the QF, the less likely a spurious peak will be mistaken for molecular species. Each of the methodologies described above generated significant artifact peaks at integral multiples of actual molecular masses. To avoid skewing the QF values by easily identifiable artifacts, signals corresponding to these peaks were ignored in the calculations of QF.

Figure 3A:
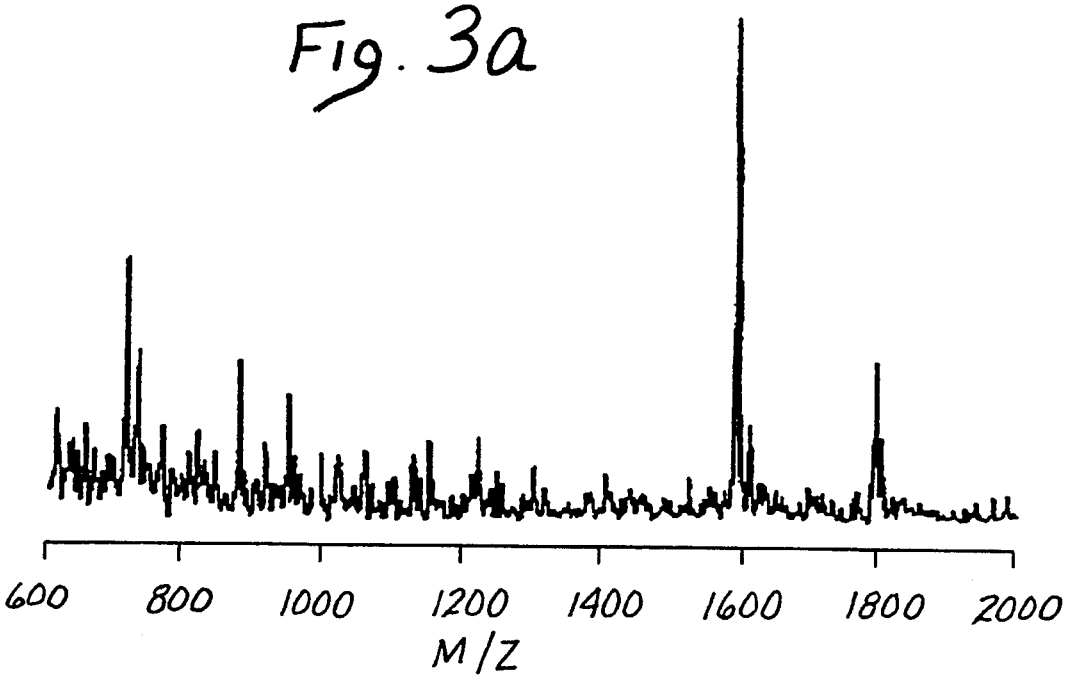
FIGS. 3*a* through 3*d* are mass spectra for a lysozyme analyte.
Figure 3C:
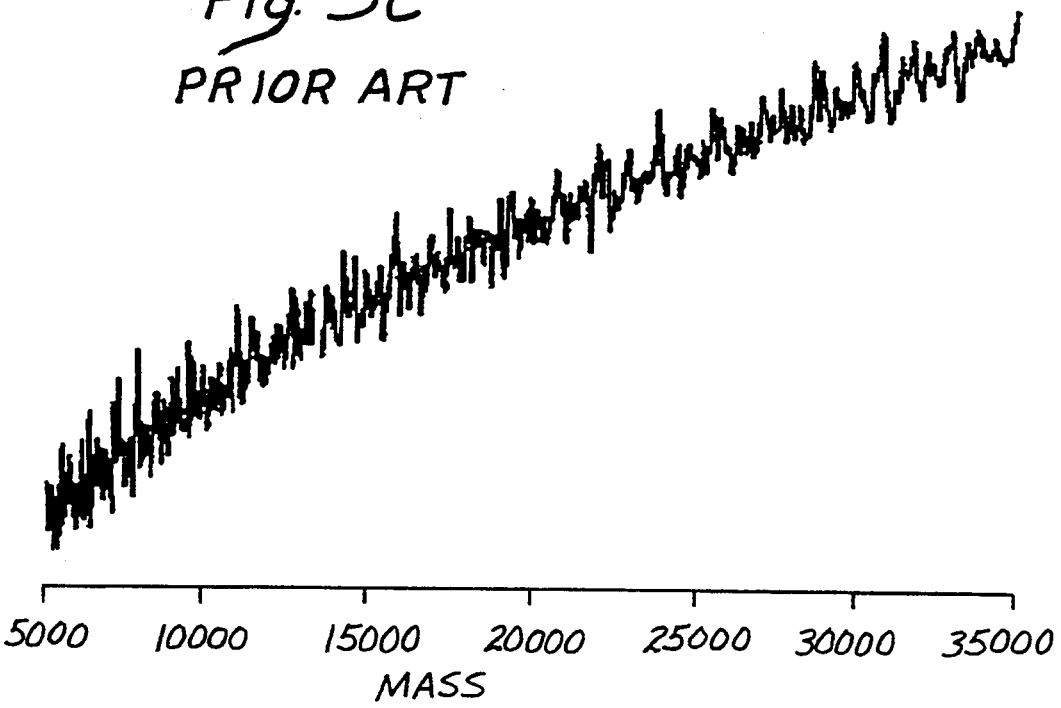
Fig. 3c PRIOR ART
Figure 3B:
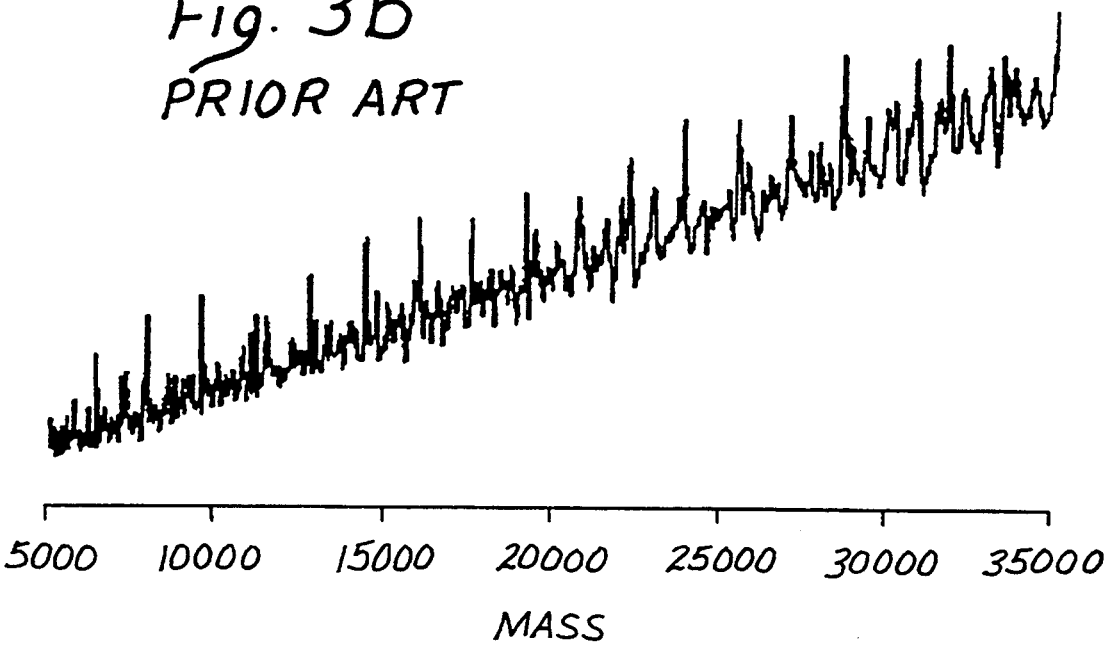
Fig. 3b PRIOR ART
Figure 3D:
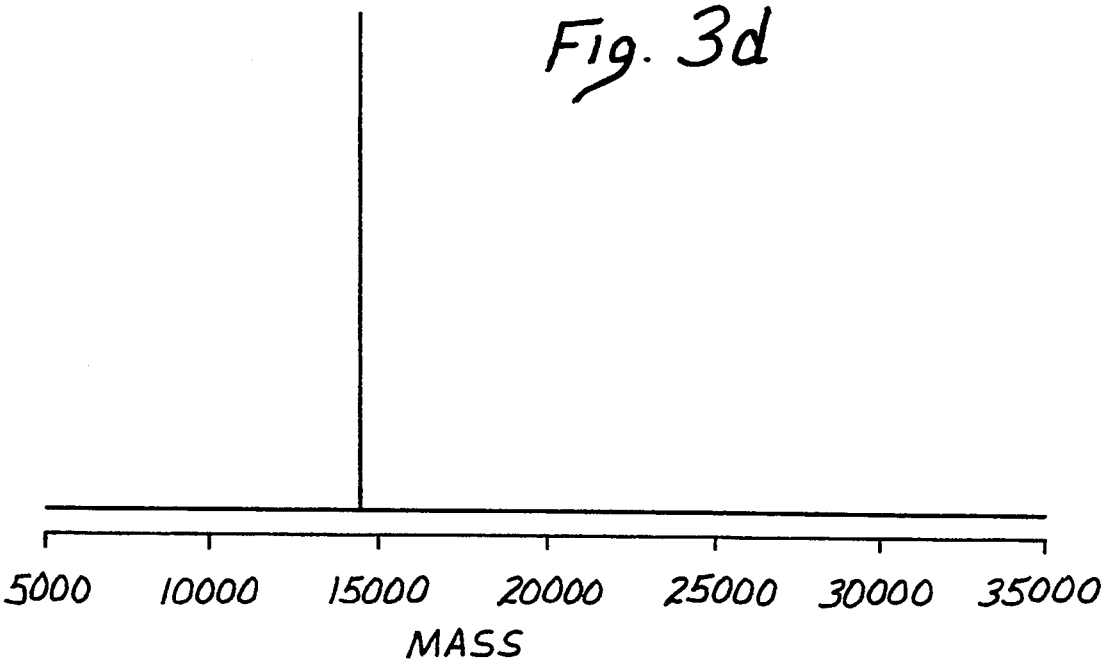

Turn now to FIGS. 3*a–d* wherein the relative performance of the Mann and Reinhold methodologies are compared with the multiplicative deconvolution methodology as applied to actual data. FIG. 3*a* shows an electrospray mass spectrum generated when 3.51 fmol of lysozyme is introduced into a conventional mass spectrometer as described above. Two peaks corresponding to lysozyme are clearly evident at the 1600 and 1800 mass-to-charge units in FIG. 3*a*. FIG. 3*b* shows the mass spectrum generated by the Mann methodology based upon the spectrum measured in FIG. 3*a*. Although a peak corresponding to the correct molecular mass of lysozyme of 14,306 as reported in the literature is measured at 14,317.5 in the enhanced spectrum of FIG. 3*b*, many spurious peaks are also present which clutter the spectrum and make interpretation difficult. The spectrum of FIG. 3*b* has a quality factor value, QF, equal to 1.1656.

In FIG. 3*c* the mass spectrum of FIG. 3*a* is analyzed according to the Reinhold methodology. In this example, the maximum entropy or Reinhold methodology provides little if any signal at the appropriate mass points resulting in QF of less than 1.

Finally, in FIG. 3*d* the mass spectrum of FIG. 3*a* is analyzed with the multiplicative correlation methodology of the invention. The methodology of the invention produces a more easily interpreted spectrum with a quality factor of QF equals $1.558\times10^{7}$ than do either of the prior art Mann or Reinhold enhanced spectrums. In the example, the enhanced spectrum is trivially interpreted.

Lysozyme, cytochrome c and myoglobin standards spanning six orders of magnitude in concentration were prepared, mass analyzed and processed using the multiplicative deconvolution methodology of the invention. In each case, the QF of the calculated spectrum was greater than $10^{60}$ which was the dynamic range of the calculations, until the concentration of the standard was within one order of magnitude of the detection limit of the mass spectrometer. In this region the QF of the calculated spectrum was rapidly reduced as concentration dropped. Nevertheless, in all cases, the QF of a spectrum produced according to the invention greatly exceeded the QF of spectrum generated by prior art algorithms at the same concentrations of analyte.

Figure 4A:
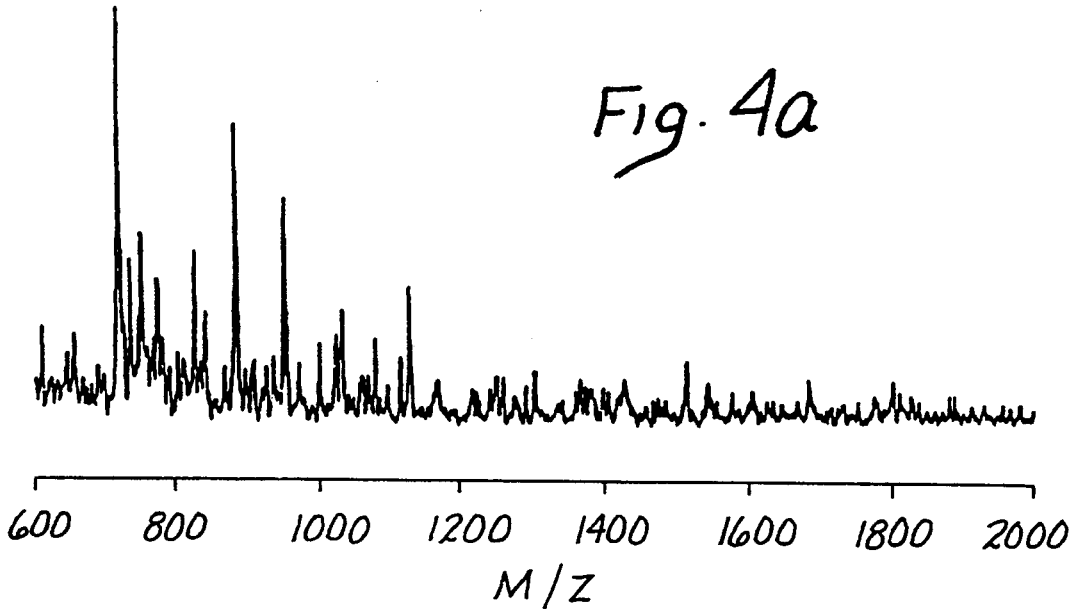
FIGS. 4*a*–4*c* are drafts of data output for a cytochrome c analyte.
Figure 4B:
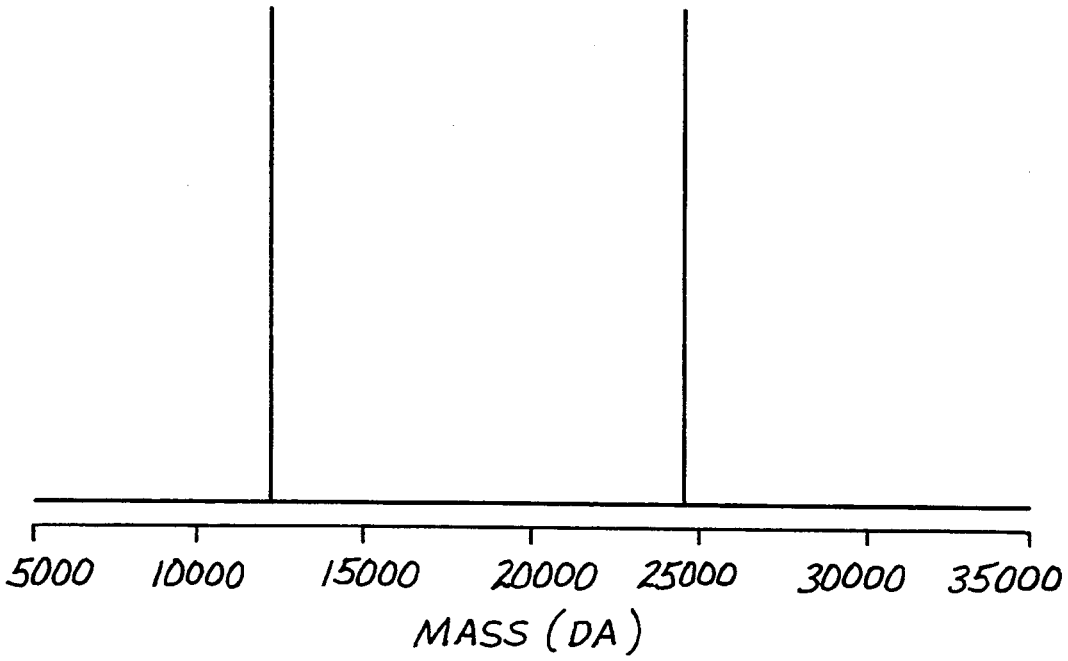
Figure 4C:
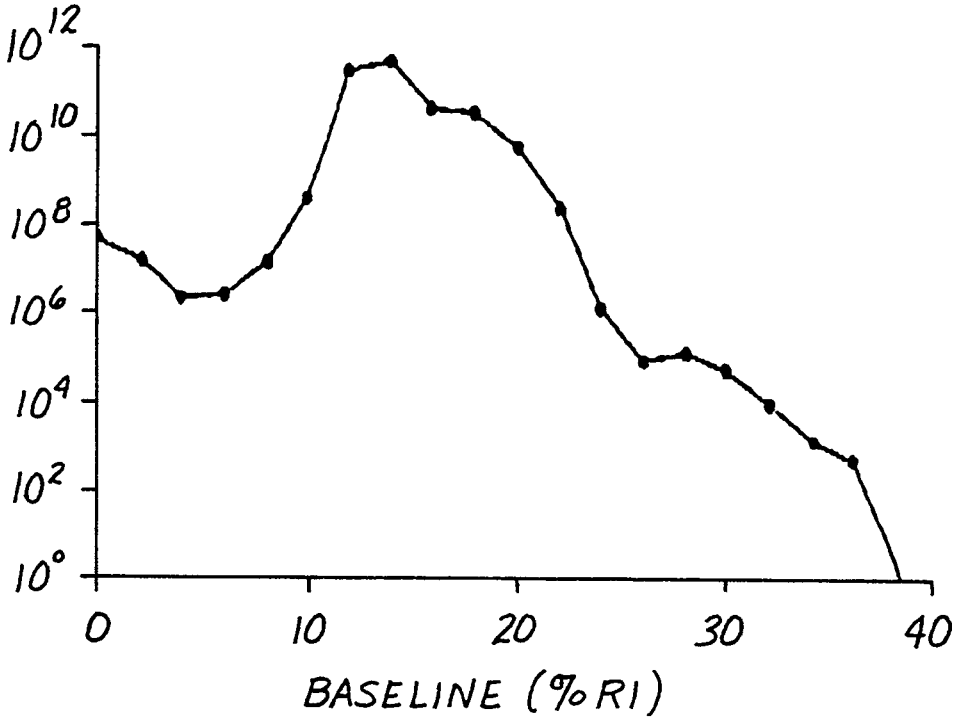

The quality of the spectrum can be enhanced by establishing a threshold intensity below which data is ignored. The threshold is defined in terms of its relative intensity, RI, where 0% RI is the lowest intensity and 100% RI is defined as the highest intensity in the mass-to-charge spectrum. FIG. 4*a* shows a spectrum acquired from mass spectrometer with 13.6 fmol of cytochrome c. The spectrum was used to demonstrate the effect of baseline discrimination of the calculated spectrum using the invention. FIG. 4*b* shows the mass spectrum of FIG. 4*a* calculated according to the invention using a threshold baseline of 14% RI. FIG. 4*c* is a graph of the log of QF for a spectrum versus the height of the threshold value in % RI using the invention. The effect of establishing a baseline threshold below which the intensity of data is ignored, is shown in FIG. 4*c* to have a significant effect on the quality of the calculated spectrum. A drop in QF between 0 and 10% RI is due to the elimination of low level noise while including the contribution from high level noise. The greatest enhancement is seen when the baseline is set to include a maximum signal with a minimum of noise. In the illustrated embodiment of FIG. 4*c*, this is a baseline at approximately 14% RI. Using a higher value for the baseline causes the elimination of signal contribution without corresponding elimination of noise contribution thereby reducing the QF with the resulting calculating spectrum. The point of maximum enhancement given by the use of a baseline will also vary from spectrum to spectrum. Thus the use of baseline discrimination gives enhancement in the QF, but care must be taken when setting the cut off intensity in the calculations in order to actually maximize the enhancement.

The use of a calculation window can also have significant effects in the calculated spectrum. Improvements in the QF of $10^{16}$ to $10^{17}$ in a spectrum using a window can easily be observed. The maximum enhancement is obtained when the window width matches the width of the analyte peaks in the mass-to-charge spectrum. In this case, all the analyte signals are included in the calculation with the inclusion of a minimum amount of noise. The effect of the mass accuracy in the calculated spectrum is minimal. Shifts in peak position of 5 to 10 Daltons over the range of a 0 to 10 amu window width is not uncommon, but are within the error of the instrument calibration and correlation algorithms.

Figure 5A:
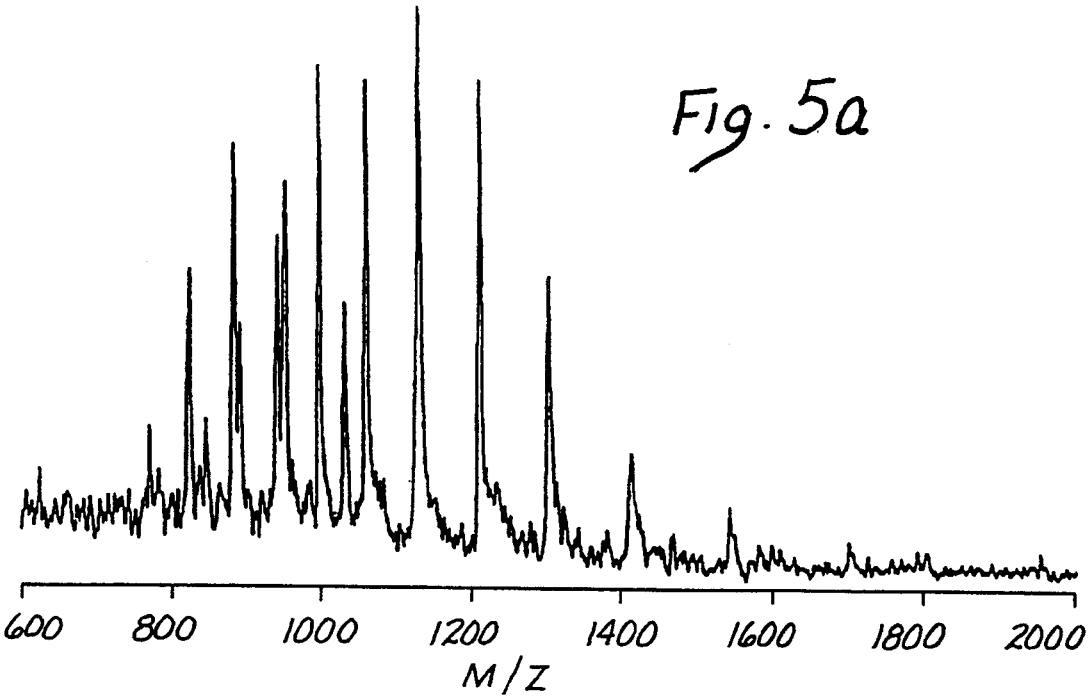
FIGS. 5*a* and 5*b* are graphs showing the output with a multicomponent analyte comprised of myoglobin and cytochrome c.
Figure 5B:
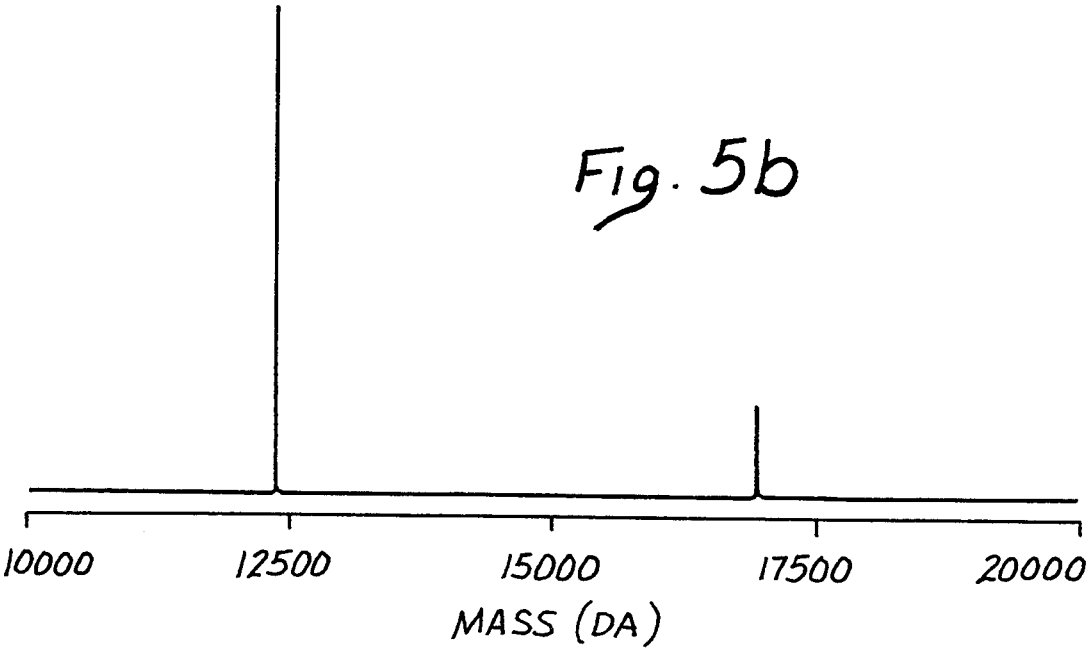

The ability of the methodology of the invention to simultaneously detect compounds is of great importance when analyzing unknown samples whose purity is not known or guaranteed. FIG. 5*a* shows electrospray spectrum where 7.43 fmol of horse heart myoglobin and 13.6 fmol of cytochrome c were introduced simultaneously into the mass analyzer. The output spectrum which is enhanced according to the invention is shown in FIG. 5*b*. One of the problems in analysis of mixtures with significantly overlapping peak envelopes is the partial correlation which is seen between peaks from different envelopes, which partial correlation produces a greatly reduced QF. However, with the added enhancement provided by a calculation window, on some occasions the intensity of calculated artifact peaks from the partial correlation of peaks of major components in the analyte will exceed the intensity of peaks from trace components in the analyte.

There is also a loss of peak shape in the deconvolution spectrum with the addition of the calculation window. Thus, spectral information from low molecular weight adducts can be lost. Therefore, additional enhancement to these windows is gained at the loss of other information. As a result, window calculations may be desirable only in the case where there is a low signal-to-noise ratio and the extra enhancement is needed.

The ability to resolve molecular ions of similar mass is a function of the mass difference between the two ions and the width of reconstructed ion peaks. While the mass difference is entirely determined by the structure of the two molecules, the width of each of the reconstructed peaks is usually determined by instrument parameters and the algorithm used to process the data. If either of these parameters are adjusted to reduce the width of the peaks, the resolving power of the instrument is increased. Expressed as a full width at half the maximum intensity, the peak from the calculated spectra for myoglobin generated by the Mann, Reinhold and present invention have widths of 99.73, 100.73 and 4.49 Daltons respectively.

Figure 6A:
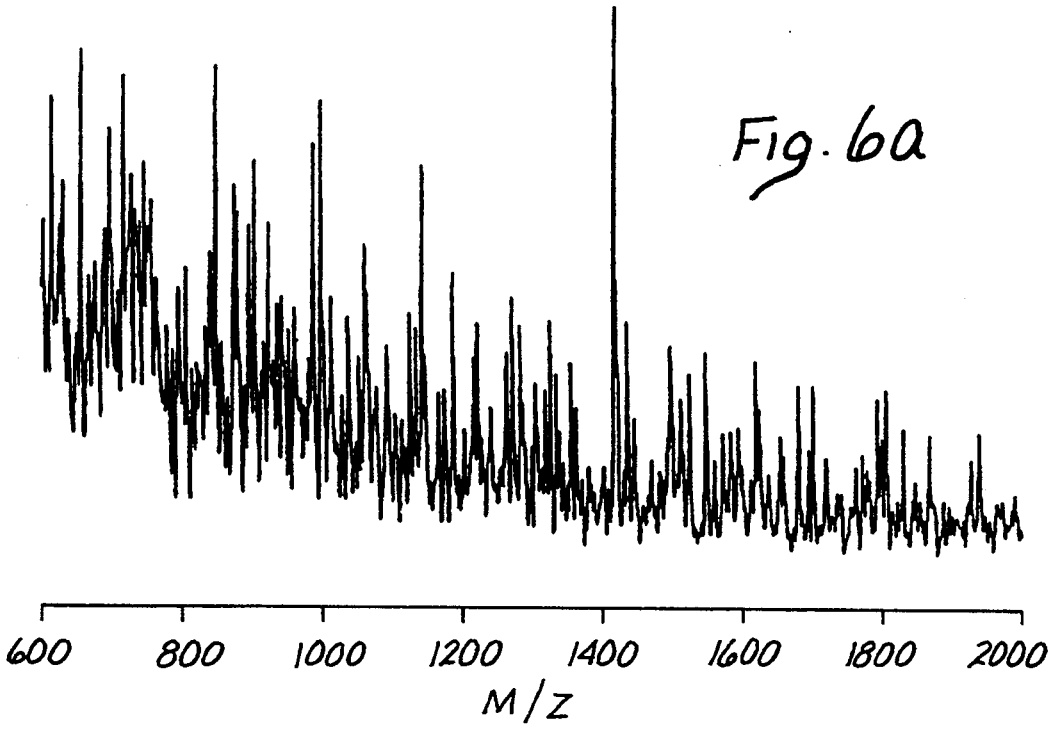
FIGS. 6*a* and 6*b* are graphs showing the analysis of an ESI spectrum of myoglobin from mass spectrometer.
Figure 6B:
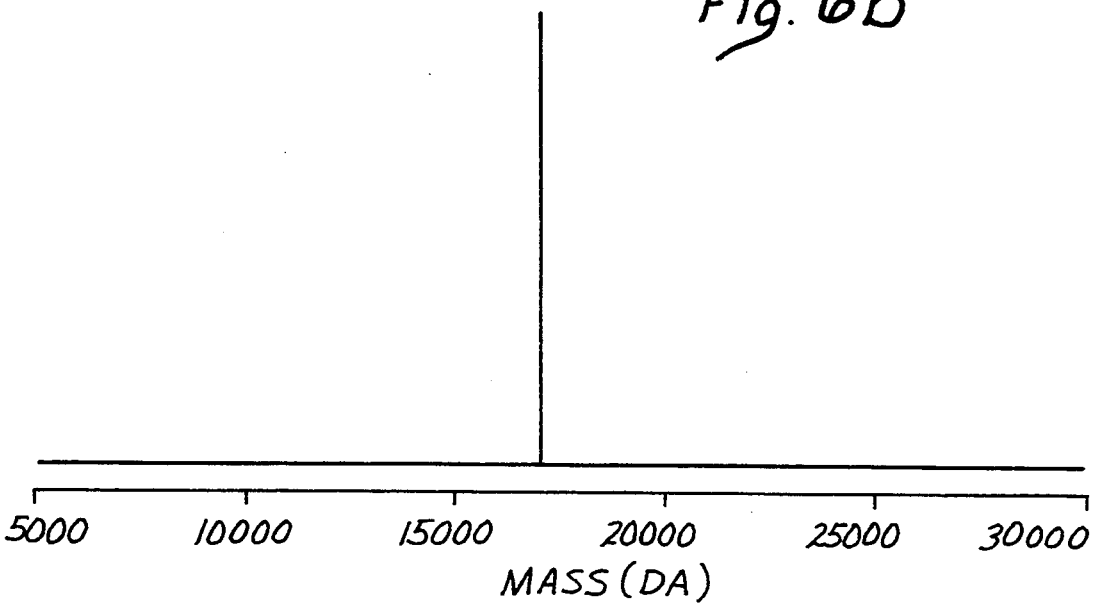

One of the primary strengths of the present invention is the ability to generate a deconvoluted spectrum of high quality from a sample spectrum which has a relatively low signal-to-noise ratio. FIG. 6*a* shows a spectrum generated in a conventional mass spectrometer when 1.82 fmols of myoglobin is introduced. The output according to the invention is shown in FIG. 6*b*. The quality of the spectrum is high, QF equal 8540, and it illustrates the power of the methodology to allow the detection limits to be significantly lowered for electrospray analysis. This ability is very important when the technique is used to analyze samples of biological origin and the sample may be at low concentrations and/or of a limited sample size. This ability is also of utility for electrospray ionization coupled with separation techniques such as capillary high pressure liquid chromotography and capillary electrophoresis.

Thus, it can now be understood that the multiplicative deconvolution methodology of the invention offers significant advantages relative to prior art methodologies used to interpret mass-to-charge spectra of multiply charged ions in mass spectrometers. Significant enhancement of the calculated spectrum is realized by establishing a stringent requirement for correlating peaks in the mass-to-charge envelope, by limiting the mass-to-charge values which are used in the calculation of the output spectrum, and by using a calculation window around each peak. By efficiently utilizing information contained in the mass-to-charge spectrum, the methodology of the invention permits an interpretable mass spectrum to be acquired with significantly less amounts of analyte. These enhanced analytical capabilities minimize the opportunity for misinterpretation of the electrospray mass spectrum and allow the technology to be applied to problems which could previously not be addressed with this type of instrumentation.

Many alterations and modifications may be made by those having ordinary skill in the art without departing from the spirit and scope of the invention. For example, although the preferred embodiment has been described in connection with an electrospray ionization source, any source now known or later devised producing different multiples on charges on a molecule may be used with the invention.

Therefore, it must be understood that the illustrated embodiment has been set forth only for the purposes of example and that it should not be taken as limiting the invention as defined by the following claims. The following claims are, therefore, to be read to include not only the combination of elements which are literally set forth, but all equivalent elements for performing substantially the same function in substantially the same way to obtain substantially the same result. The claims are thus to be understood to include what is specifically illustrated and described above, what is conceptionally equivalent, and also what essentially incorporates the essential idea of the invention.

We claim:

1. A method for identifying the molecular weight of distinct polyatomic parent molecular species in a mass spectrometer comprising the steps of:

generating populations of multiply charged ions on said distinct polyatomic parent molecular species, the number of charges on said ions defining each of said ion's charge state number, said population of ions comprising a plurality of subpopulations, each of said subpopulations corresponding to an intensity peak in a mass-to-charge spectrum of said molecular species, said population including one of said subpopulations for at least one possible integral value of a charged state number;

analyzing subpopulations in said mass spectrometer to produce said mass-to-charge spectrum;

determining a mass-to-charge range to be used with said mass-to-charge spectrum;

determining a range of assumed masses to be used within an enhanced mass spectrum; and generating for each assumed mass in said enhanced mass spectrum an intensity equal in magnitude to the product of all of said intensity peaks of said subpopulations of said assumed mass, whereby determination of said molecular weight of said polyatomic parent molecule species is more readily discernible.

2. The method of claim 1 where said step of generating said enhanced intensity comprises the step of generating an enhanced intensity, I[M], equal magnitude to a product modeled on the equation:

$$I(M)=[I[M/x+m_c]*I[M/(x+1)+m_c]*I[M/(x+2)+m_c]*\ldots*I[M/y+m_c]]/rms^n$$

where M is the molecular mass assumed in said enhanced spectrum, I[M/n] is said intensity of said subpopulations at a mass-to-charge value of n, where x and y are the minimum/maximum number of charges of said charged state number per molecule, where $m_c$ is the mass of a counter ion, where rms is root mean square of said selected range of said mass-to-charge spectrum, and where n is the number of intensity peaks within said product.

3. The method of claim 1 wherein said step of generating said enhanced spectrum only uses intensity peaks of said subpopulation within said mass-to-charge spectrum greater than a predetermined threshold.

4. The method of claim 2 wherein said step of generating said enhanced spectrum only uses intensity peaks of said subpopulation within said mass-to-charge spectrum greater than a predetermined threshold.

5. The method of claim 3 wherein said predetermined threshold is set at about 0.01% of the maximum intensity found within said mass-to-charge spectrum.

6. The method of claim 3 wherein said predetermined threshold has a characteristic maximum value for each spectrum at which a quality factor, QF, is maximized, said predetermined threshold being set at said maximum value to maximize said quality factor, said quality factor being defined as the ratio of the intensity peaks of said subpopulations at a true molecular mass divided by intensity peaks at mass values other than said true molecular mass.

7. The method of claim 1 wherein said intensity peaks within said mass-to-charge spectrum have a finite width, said enhanced spectrum being generated from said intensity peaks of said subpopulations using said finite width of each said intensity peaks.

8. The method of claim 7 wherein said enhanced spectrum is modeled by the equation:

$$I(M)=X_x*X_{x+1}*X_{x+2}*\ldots *X_y$$

where $X_n$ $$X_n=[I[m_n-w/2]*I[m_n-w/2+d]*I[m_n-w/2+2d]*\ldots *I[m_n+w/2]]/rms^{n/d}$$

and $$m_n=M/n+m_c$$

where M is the molecular mass assumed in said enhanced spectrum, $X_n$ is a measure of said intensity of said subpopulations centered at a mass-to-charge value of $m_n$, where x and y are the minimum/maximum number of charges of said charged state number per molecule, where $m_c$ is the mass of a counter ion, where rms is root mean square of said selected range of said mass-to-charge spectrum, where n is the number of intensity peaks within said product, where w is a calculation window and d is the mass difference at successive points in the mass-to-charge spectrum from which said enhanced spectrum is generated.

9. The method of claim 3 wherein said intensity peaks within said mass-to-charge spectrum have a finite width, said enhanced spectrum being generated for each of said intensity peaks of said subpopulations using said finite width of said intensity peak.

10. The method of claim 5 wherein said intensity peaks within said mass-to-charge spectrum have a finite width, said enhanced spectrum being generated from intensity peaks of said subpopulations using said finite width of said intensity peak.

11. The method of claim 6 wherein said intensity peaks within said mass-to-charge spectrum have a finite width, said enhanced spectrum being generated from intensity peaks of said subpopulations using said finite width of said intensity peak.

12. The method of claim 1 wherein said enhanced spectrum is generated from a data set of data points corresponding to equivalent masses of said polyatomic parent molecular species comprising the steps of:

determining a root mean square of said data set;

normalizing said data set by dividing each data point by said root mean square of said data set;

determining a width, w, of a window;

generating a product spectrum where each point of said product spectrum is a product of all the data points within said data set within one half of said window width, w/2, in said normalized spectrum; and generating said enhanced intensity I[M], equal magnitude to a product modeled on the equation:

$$I(M)=[I[M/x+m_c]*I[M/(x+1)+m_c]*I[M/(x+2)+m_c*\ldots *I[M/y+m_c]]$$

where M is the molecular mass assumed in said enhanced spectrum, I[M/n] is said intensity of said product spectrum at a mass-to-charge value of n, where x and y are the minimum/maximum number of charges of said charged state number per molecule, where $m_c$ is the mass of a counter ion, and where n is the number of intensity peaks within said product.

13. The method of claim 6 wherein said enhanced spectrum is modeled by the equation:

$$I(M)=X_x*X_{x+1}*X_{x+2}*\ldots *X_y$$

where $X_n$ $$X_n=[I[m_n-w/2]*I[m_n-w/2+d]*I[m_n-w/2+2d]*\ldots *I[m_n+w/2]]/rms^{n/d}$$

and $$m_n=M/n+m_c$$

where M is the molecular mass assumed in said enhanced spectrum, $X_n$ is a measure of said intensity of said subpopulations centered at a mass-to-charge value of $m_n$, where x and y are the minimum/maximum number of charges of said charged state number per molecule, where $m_c$ is the mass of a counter ion, where rms is root mean square of said selected range of said mass-to-charge spectrum, where n is the number of intensity peaks within said product, where w is a calculation window and d is the mass difference at successive points in the mass-to-charge spectrum from which said enhanced spectrum is generated.

14. An improved combination of a mass spectrometer and computer comprising:

means for generating a mass spectrum comprised of a sequence of discrete peaks due to multiply charged ions of a distinct polyatomic parent molecular species;

means for storing said mass spectrum within said computer;

means for generating an enhanced mass spectrum by combining said sequence of discrete peaks due to multiply charged ions of said distinct polyatomic parent molecular species to form an intensity for each assumed mass within said enhanced spectrum, said discrete peaks being combined in a product, whereby analysis of said peaks of said enhanced spectrum to determine the molecular weight of said distinct polyatomic parent molecular species is facilitated.

15. The improved combination of claim 14 where said means for generating said enhanced spectrum combines said sequence of discrete peaks in a normalized product, said product being normalized by the root mean square value of said mass spectrum stored in said computer in a predetermined range from which said enhanced spectrum is generated.

16. The improved combination of claim 15 wherein said means for combining said sequence of discrete peaks in a product combines said products as modeled by the equation:

$$I(M)=[I[M/x+m_c]*I[M/(x+1)+m_c]*I[M/(x+2)+m_c]*\ldots*I[M/y+m_c]]/rms^n$$

where M is the molecular mass assumed in said enhanced spectrum, I[M/n] is said intensity of said subpopulations at a mass-to-charge value of n, where x and y are the minimum/maximum number of charges of said charged state number per molecule, where $m_c$ is the mass of a counter ion, where rms is root mean square of said selected range of said mass-to-charge spectrum, and where n is the number of intensity peaks within said product.

17. The improved combination of claim 14 wherein said means for generating said enhanced spectrum by combining said sequence of discrete peaks in a product combines only those discrete peaks in said product which exceed a predetermined threshold.

18. The improved combination of claim 14 wherein said means for generating said enhanced spectrum by combining said sequence of discrete peaks in a product includes within said product a subsequence of intensities for each of said discrete peaks within a width for each peak.

19. The improved combination of claim 17 wherein said means for generating said enhanced spectrum by combining said sequence of discrete peaks in a product includes within said product a subsequence of intensities for each of said discrete peaks within a width of each peak.

20. The improved combination of claim 18 where said means for generating said enhanced spectrum from said sequence of discrete peaks in a product generates said enhanced intensity as modeled by the equation:

$$I(M)=X_x*X_{x+1}*X_{x+2}*\ldots*X_y$$

where $X_n$ $$X_n=[I[m_n-w/2]*I[m_n-w/2+d]*I[m_n-w/2+2d]*\ldots*I[m_n+w/2]]/rms^{n/d}$$

and $$m_n=M/n+m_c$$

where M is the molecular mass assumed in said enhanced spectrum, $X_n$ is a measure of said intensity of said subpopulations centered at a mass-to-charge value of $m_n$, where x and y are the minimum/maximum number of charges of said charged state number per molecule, where $m_c$ is the mass of a counter ion, where rms is root mean square of said selected range of said mass-to-charge spectrum, where n is the number of intensity peaks within said product, where w is a calculation window and d is the mass difference at successive points in the mass-to-charge spectrum from which said enhanced spectrum is generated.

* * * * *